US005732609A

United States Patent [19]

Marschke

[11] Patent Number: 5,732,609

[45] Date of Patent: Mar. 31, 1998

[54] SHEET SAVING DIVERTER FOR CORRUGATOR

[75] Inventor: Carl R. Marschke, Phillips, Wis.

[73] Assignee: Marquip, Inc., Phillips, Wis.

[21] Appl. No.: 816,493

[22] Filed: Mar. 13, 1997

Related U.S. Application Data

[63] Continuation of Ser. No. 427,048, Mar. 24, 1995, abandoned.

[51] Int. Cl.[6] ..... B26D 5/20

[52] U.S. Cl. ..... 83/92.1; 83/106; 83/155.1; 83/167; 198/369.2; 198/836.1; 271/303

[58] Field of Search ..... 83/165, 157, 92.1, 83/92, 93, 90, 106, 105, 155, 155.1, 152, 167, 86, 94, 342, 345; 271/303, 305, 198, 279; 198/369.2, 370.03, 370.1, 836.1, 303

[56] References Cited

U.S. PATENT DOCUMENTS

| | | | |
|---|---|---|---|
| 2,142,812 | 1/1939 | Brustowsky | 83/90 |
| 2,978,941 | 4/1961 | Geiszler et al. | 83/106 |
| 3,169,428 | 2/1965 | Owen | 83/371 |
| 3,262,699 | 7/1966 | Aschenbrenner | 83/155 |
| 3,375,744 | 4/1968 | Schieven | 83/93 |
| 3,410,183 | 11/1968 | Sarka | 83/152 |
| 3,550,493 | 12/1970 | Benbenek | 83/155 |
| 4,235,434 | 11/1980 | Müller | 271/305 |
| 4,697,486 | 10/1987 | Vulcano | 83/167 |
| 4,815,924 | 3/1989 | Jaatinen | 83/93 |
| 5,193,423 | 3/1993 | Bakker | 83/152 |

*Primary Examiner*—Maurina T. Rachuba
*Attorney, Agent, or Firm*—Andrus, Sceales, Starke & Sawall

[57] ABSTRACT

A corrugator dry end includes a sheet saving diverter positioned immediately downstream of a rotary shear and a conventional scrap diverter. Useable sheets may be cut to selected useable lengths, diverted and stacked without damage, and without slowing the corrugator line. The useable sheet diverter includes a vacuum diverting conveyor and vacuum shingler which deliver sheets into an adjustable stacking bin.

7 Claims, 2 Drawing Sheets

SHEET SAVING DIVERTER FOR CORRUGATOR

This is a continuation of application Ser. No. 08/427,048, filed Mar. 24, 1995, now abandoned.

BACKGROUND OF THE INVENTION

The present invention pertains to a system used in the manufacture of paperboard and, more particularly, to a system for diverting and saving useable corrugated paperboard sheets cut from a running paperboard web by a rotary shear.

A conventional corrugator dry end receives a running web of corrugated paperboard from the double backer and processes the web into cut sheets which are stacked at the end of the dry end for converting into boxes or loaded and banded for shipping. Immediately adjacent the outlet from the double backer is a rotary shear which is typically used to cut out defective web, such as loose back, remove splices which may appear in any of the component webs of the paperboard, or to create a gap in the web at an order change in order to allow downstream equipment, such as the slitter/scorer to be repositioned. Defective material and material containing splices is unuseable and the shear is typically operated at synchronous speed to simply chop equal length scrap sheets from the web. The scrap sheets are diverted into a scrap bin immediately downstream from the shear without regard to bending, breaking or otherwise damaging the scrap sheets which are unuseable anyway.

However, when effecting an order change, it is often necessary to chop out and divert into the scrap bin a number of sheets which are cut from good useable web. The length of the gap which must be formed in the web necessarily depends on the time needed to reposition the downstream equipment and, as a result, a relatively lengthy order change will result in the scrap out of a larger number of potentially useable sheets. Further, it is not practical to separate useable sheets from scrap which are together diverted into a single scrap bin because of the time and labor required. Also, the scrap diverter typically operates at line speed and uses nipping devices which damage the sheets. Finally, scrap cut at equal synchronous shear operating lengths is typically not useable even if undamaged.

It is possible to minimize the length of scrap cut and time required to divert it at order change by slowing the speed of the upstream wet end corrugating line. However, slowing the corrugator is very undesirable because it may lead to defects or diminished quality in the web.

Thus, it would be most desirable to have a system for cutting and diverting useable length sheets from the web at order change in a manner which would not damage the sheets or require slow down of the corrugator. Ideally, such a system would also allow variation in the cut length of the useable diverted sheets.

SUMMARY OF THE INVENTION

In accordance with the present invention, a separate sheet-saving diverter is added to a corrugator dry end immediately downstream of the shear and scrap diverter in a manner allowing selective use of either of the diverters.

In accordance with a preferred embodiment, the dual diverter system of the present invention operates on a traveling paperboard web, typically a single or multiple wall corrugated paperboard web, which is traveling along a normal web path from an upstream double backer through a rotary shear. The dual diverter system permits scrap sheets to be cut and scrapped, and useable sheets to be cut and saved from a portion of the traveling web which is removed to form a gap. The system includes scrap diverter means located directly adjacent the web outlet from the shear for diverting scrap sheets cut by the shear, the scrap diverter means including a scrap divert apparatus which is movable between a passive web passage position and an active scrap divert position; sheet diverter means positioned downstream of the scrap diverter means for diverting useable sheets cut by the shear, the sheet diverter means including a diverting section which captures a useable sheet, a shingling section which slows and shingles the sheet, and a stacking device for stacking the useable sheets; and, means for controlling the shear to selectively allow the production of cut scrap length sheets and variable length useable sheets.

The diverting section of the sheet diverter means includes a vacuum conveyor which has a curved conveying surface positioned generally tangent at its upstream end to the normal web path and which extends downwardly to the shingling section, with the radius of curvature of the conveying surface being large enough to allow bending of the sheet without breaking. Vacuum distribution means are provided on the surface of the conveying surface to hold the captured sheet thereon. The vacuum distribution means preferably includes a main vacuum application section which extends laterally beneath the web at the upstream end of the conveying surface and spaced from the cut line of the shear at a distance less than the selected minimum length of the useable sheet. The vacuum distribution means also preferably includes a plurality of secondary vacuum channels which extend along the conveying surface in the direction of sheet movement from the main vacuum application section.

In the preferred embodiment, the shingling section utilizes a vacuum shingler. The useable sheet stacking device comprises a sheet bin which has a sloping sheet receiving surface extending downwardly from the shingling section and a sheet stop surface which is selectively positionable to provide a sheet receiving surface length equal to the useable sheet length, and means for lowering the bin vertically in response to increasing height of the stack of useable sheets deposited therein. The bin also includes means for pivoting the bin on a horizontal axis which is generally coincident with a line of intersection of the receiving surface and the stop surface, allowing the bin to be pivoted between a sheet receiving position and a stack discharge position.

DETAILED DESCRIPTION OF THE PREFERRED EMBODIMENT

Figure 1:
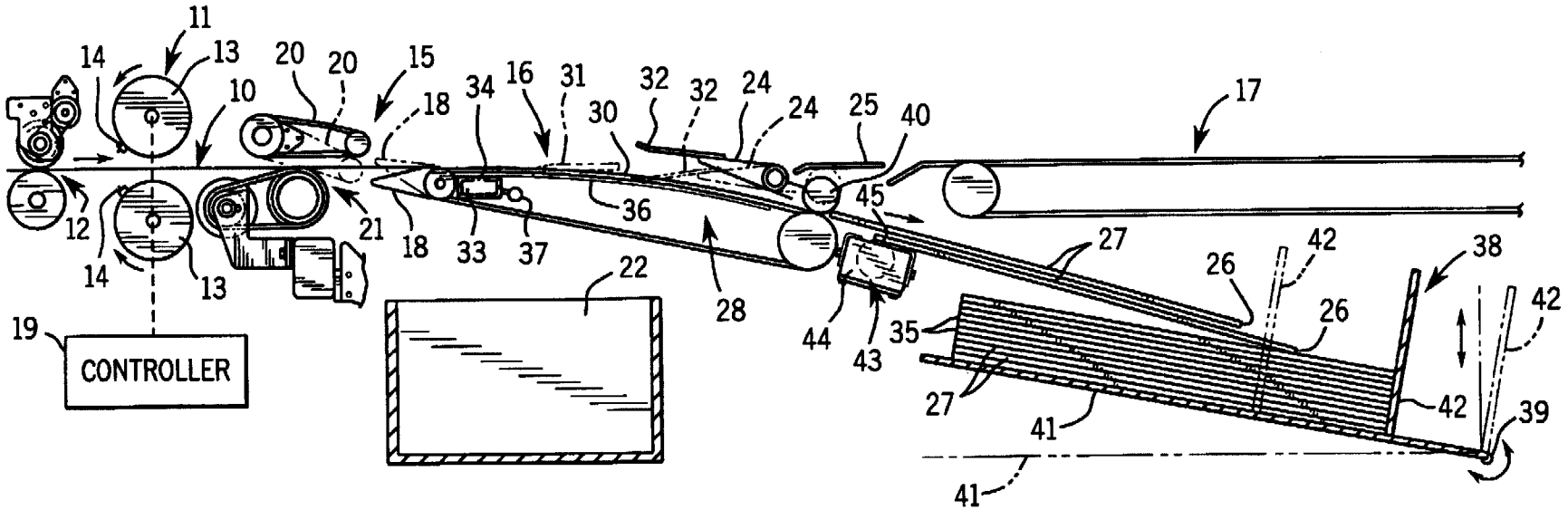
FIG. 1 is a side elevation of the dual diverter system of the present invention shown with the rotary shear and with the useable sheet diverter in their operative positions.
Figure 2:
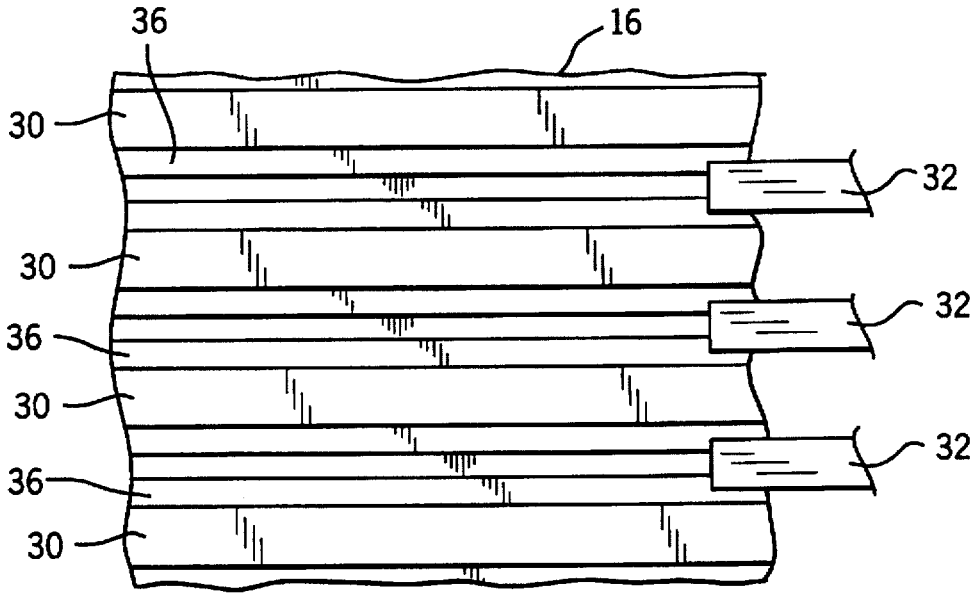
FIG. 2 is a top plan view of a portion of the system shown in FIG. 1.

A corrugated paperboard web 10 is shown traveling through an upstream rotary shear 11 which is typically positioned just downstream of a double backer (not shown) where the component paper webs are adhesively joined to form the composite paperboard web, all in a manner well known in the art. A powered nip 12 assists in pulling the web from the double backer and feeding it through the shear 11. The shear includes upper and lower driven knife rolls 13 to the surfaces of which are mounted interengaging helical knives 14.

A scrap diverter 15 is positioned immediately downstream of the shear in the normal path of the web 10. Similarly, a useable sheet diverter 16 or sheet saver is positioned directly downstream of the scrap diverter 15. In normal operation, the web 10 passes through the shear 11 without being cut, on through diverter 15 and over diverter 16, supported by a number of support surfaces or pans to be described, and onto a downstream conveyor 17 from which it is typically fed directly into a slitter/scorer (not shown) where the web 10 is slit along its length into narrower sheets and creased with longitudinal score lines along which bends or the like are formed in a subsequent conversion process.

If it is desired to cut and scrap defective material from the web 10 entering the shear 11, signals from defect detection apparatus or manually entered operator signals cause the knife rolls 13 to rotate at constant speed matched to incoming web speed to cut out one or more sheets, as may be necessary to remove the total length of defective material. This synchronous operation of the shear 11 results in scrap sheets of a length equal to the circumference circumscribed by the helical knives 14. This synchronous length is typically non-standard and, because the web material is defective, the synchronous length is of no consequence. To activate the scrap diverter 15, a scrap divert pan 18 is pivoted upwardly into the normal web path. Simultaneously, a powered diverter belt 20 is moved from its upper inoperative position out of contact with the web 10 downwardly to capture the scrap sheet in a divert nip 21 to direct the scrap sheet under the upturned scrap divert pan 18 and into a scrap bin 22. The subsequent synchronous shear cut produces the tail end of the scrap sheet and, as necessary, the leading edge of the next scrap sheet. Synchronous operation of the shear continues until all identified defective web length has been chopped out and diverted into the scrap bin 22. The divert nip 21 formed by downward movement of the diverter belt 20 typically crushes the corrugated medium in the paperboard web and/or produces a permanent laterally extending crease or break in the sheet. This is typically of no consequence since the material being chopped out is defective. Also, during scrap chop out, the web 10 may continue to be fed from the upstream double backer at normal corrugator operating speed which may, for example, be 1,000 feet per minute (305 m/min).

The rotary shear 11 is also utilized to create a longitudinal gap in the web 10 to allow adjustment and repositioning of the downstream dry end equipment at order change. In one type of slitter/scorer, the rotary slitting and scoring tools remain in the path of the traveling web 10 and are shifted laterally to their new positions for processing the new order when the gap appears. Depending on the complexity and time needed for repositioning, the gap may vary from only one sheet length to a substantial number of sheet lengths. The scrap diverter 15 may be used to create the gap for an order change, but the scrap sheets are unuseable, even if cut from good web material, because of damage in passage through the divert nip 21. Potentially useable scrap may be minimized at order change by slowing the upstream portion of the web leaving the corrugator double backer. However, slowing the web is undesirable because of the potentially adverse effects on quality and high likelihood of generating additional scrap.

The useable sheet diverter 16 allows sheets cut from good web at order change to be diverted and saved and, when combined with controlled operation of the rotary shear 11 using a conventional controller 19, can divert useable sheets cut to standard lengths which may be varied within maximum and minimum limits to provide good useable board. The ability to save useable sheets also minimizes or obviates concerns with gap length and/or decreasing the speed of the corrugator.

In normal operation, the continuous running web 10 is supported for travel over the useable sheet diverter 16 by upstream web support fingers 31, a downstream diverter pan 24 (the web supporting positions of which are shown in phantom), and a stationary support pan 25 between the downstream diverter pan 24 and the downstream conveyor 17.

When it is desired to cut and divert useable sheets, the leading edge 26 of the useable sheet 27 is captured on the upstream end of a vacuum conveyor 28 which forms the diverting section of the useable sheet diverter 16. The vacuum conveyor 28 includes a series of laterally spaced driven belts 30 between which the spaced fingers 31 are moved downwardly to allow the sheet lead edge 26 to be diverted from the normal web path. Similarly, the downstream diverter pan 24 includes upstream fingers 32 which are positioned between the driven belts 30 when the web is traveling in its normal path over the diverter 16, but which pivot up with the diverter pan 24 when the useable sheet 27 is diverted onto the vacuum conveyor 28, as shown in the full line positions in the drawing.

The vacuum distribution system for the vacuum conveyor 28 includes a main vacuum plenum 33 at the upstream end. The main vacuum plenum includes a series of laterally extending vacuum openings 34 which are located between the driven belts 30, and which may be selectively activated to accommodate webs of varying width. The leading edge 26 of the useable sheet 27 must be captured by the main vacuum openings 34 before the subsequent shear cut to form the trailing edge 35 (which, of course, may also be the leading edge of the next sheet or the end of a gap formed in the web 10). This is necessary in order to maintain control of the diverted useable sheet 27.

The belts 30 of the vacuum conveyor 28 are driven at an overspeed with respect to the normal speed of the web through the system. For example, the driven belts 30 may be made to operate at 1,100 feet per minute (335 m/min) in the present example. Extending in a downstream direction from the main vacuum plenum 33 are a series of laterally spaced vacuum slots 36, also positioned between the belts 30 to apply exposed vacuum to the sheet 27 as it travels along the vacuum conveyor 28. The vacuum slots 36 help stabilize the sheet and hold it on the vacuum conveyor as it is being diverted. The vacuum slots 36 may be operatively connected to a separate vacuum source or, as shown, may be connected to the main vacuum plenum 33 and supplied from a common source 37. As indicated, the vacuum conveyor 28 is operated at a somewhat higher speed than normal line speed, but the web leading edge 26 initially captured by the main vacuum openings 34 will continue to travel at line speed until the next shear cut. The cut sheet 27 will then accelerate under the influence of the driven belt 30, creating a small space or gap between the trailing edge 35 and the following new lead edge 26.

Although the corrugated paperboard web 10 has some inherent flexibility, it cannot be bent too severely without causing a permanent lateral crease or break in the web forming one of the facing liners. Thus, the conveying surface of the vacuum conveyor 28 is formed with a curved surface of large enough radius to preclude breaking of the sheet conveyed over it.

The useable sheets 27 are collected in a stack in a sheet stacking device 38 in the form of a bin. However, to prevent sheet damage, the sheets must be slowed for serial deposit in the stacking device 38. A shingling nip roll 40 is positioned above the coaxial drive pulleys for the driven belts 30. The nip roll 40 provides a normal force on the sheet to help propel the trailing onto the vacuum shingler to be described. The sheet stacking device 38 includes a downwardly sloping sheet receiving surface 41, the downstream end of which is defined by a stop surface 42 to assist in generating a generally square stack of useable sheets. A vacuum shingler 43 is positioned between the shingling nip roll 40 and the upstream edge of the sheet receiving surface of the stacking bin 38. The vacuum shingler includes a vacuum chamber 44 having an open upper surface through which the upper peripheral surface of a driven shingling roll 45 protrudes. The roll 45 is mounted for rotation inside the vacuum chamber and is driven at a constant speed which, for the present example, may be in the range of 200–300 fpm (60–90 m/min). As the trailing edge 35 of a useable sheet 27 leaves the shingling nip roll 40, it drops onto the vacuum shingler 43 permitting the leading edge 26 of the following sheet to overlap it in the manner of a conventional shingling apparatus.

The stacking bin 38 is mounted to automatically drop vertically (while maintaining its downwardly angled orientation) in response to the build up of the stack of sheets 27 being deposited therein, all in a manner generally similar to a conventional downstacker. When the stack of sheets is complete and the stacking device is in its lowermost position, it is pivoted about a horizontal axis 39 which is generally coincident with the line of intersection of the mutually perpendicular surfaces 41 and 42 to a stack discharge position. In this position, the stack of sheets 27 may be moved laterally in either direction for discharge. The stop surface is also adjustably positionable along the sheet receiving surface 41 to accommodate the stacking of various length sheets.

The sheet saving diverter 16 of the present invention allows valuable sheets to be cut to useable lengths selected by the operator, uniformly stacked without damage, and subsequently converted as desired. The saving of useable sheets is accomplished with a corresponding elimination of an equal amount of scrap and without slowing the corrugator line from its normal operating speed.

I claim:

1. A dual diverter system for sheets cut from a corrugated paperboard web traveling along a normal web path through a rotary shear to permit scrap sheets to be shear cut and scrapped from an unuseable web portion and useable sheets of a selected length to be shear cut and saved from a useable web portion removed from the traveling web to form a gap, which gap is defined by a downstream web tail end and an upstream web lead end, said system comprising:

scrap diverter means adjacent and downstream from the shear for diverting scrap sheets cut by the shear, said scrap diverter means including a scrap diverting apparatus movable between a passive web passage position and an active scrap diverting position;

sheet diverter means positioned downstream of the scrap diverter means for diverting useable sheets cut by the shear, said sheet diverter means including a diverting section positioned to capture the leading cut edge of a useable sheet before the trailing edge is shear cut from the web lead end, a shingling section for slowing the useable sheet, and a useable cut sheet stacking device; and, means for controlling the shear to selectively cut scrap length sheets by operating the shear at synchronous speed and selected length useable sheets by operating the shear at a variable speed.

2. The system as set forth in claim 1 wherein said useable sheets have limited flexibility and will break if bent on a curve smaller than one of a minimum radius and wherein said diverting section comprises:

a vacuum conveyor having an upstream end and a curved conveying surface generally tangent at the upstream end of said conveying surface to the normal web path and extending downwardly therefrom to said shingling section, the radius of curvature of the conveying surface being larger than said minimum radius to prevent breaking of the useable sheet captured thereon; and, vacuum distribution means in the surface of said conveying surface for holding the captured sheet thereon.

3. The system as set forth in claim 2 wherein said vacuum distribution means includes a main vacuum application section extending laterally beneath the web at the upstream end of the conveying surface and spaced from the cut line of the shear a distance less than the selected length of the useable sheet.

4. The system as set forth in claim 3 wherein said vacuum distribution means includes a plurality of secondary vacuum slots extending along the conveying surface in the direction of sheet movement from the main vacuum application section.

5. The system as set forth in claim 1 wherein said shingling section comprises a vacuum shingler.

6. The system as set forth in claim 1 wherein said useable sheet stacking device comprises:

a useable sheet bin having a sloping sheet receiving surface extending downwardly from said shingling section and a sheet stopping surface selectively positionable to provide a sheet receiving surface length generally equal to the length of the useable sheet.

7. The system as set forth in claim 6 wherein said bin is pivotable on a horizontal axis generally coincident with a line of intersection of the receiving surface and the stopping surface between a sheet receiving position and a stack discharge position.

* * * * *